US005944073A

United States Patent [19]

Klein

[11] Patent Number: 5,944,073

[45] Date of Patent: Aug. 31, 1999

[54] TRANSPORTING DEVICE FOR LONGITUDINAL HOLDERS

[75] Inventor: Helmut Klein, Peüssenberg, Germany

[73] Assignee: Weckerle GmbH, Germany

[21] Appl. No.: 08/987,793

[22] Filed: Dec. 9, 1997

[30] Foreign Application Priority Data

Jul. 9, 1997 [DE] Germany ..... 197 29 377

[51] Int. Cl.[6] ..... B65B 43/42

[52] U.S. Cl. ..... 141/170; 141/13; 141/237; 141/240

[58] Field of Search ..... 141/13, 237, 238, 141/240, 242, 243, 244, 245, 129, 154, 168, 170, 178, 179, 113

[56] References Cited

U.S. PATENT DOCUMENTS 652,820 7/1900 Tuttle ..... 141/129
5,027,869 7/1991 Tsumura et al. ..... 141/104
5,353,850 10/1994 Ueda et al. ..... 141/129
5,471,819 12/1995 Weckerle .

*Primary Examiner*—David J. Walczak
*Attorney, Agent, or Firm*—Cantor Colburn LLP

[57] ABSTRACT

A device comprising a transport table, a multiplicity of longitudinal holders that can move freely in relation to one another in a square or rectangular closed circuit past various work stations by means of transport devices, which have points of contact which fit into recesses in the bottom of the longitudinal holders and drive means. The points of contact in the transport devices, when engaged in the recesses of the longitudinal holders, move the longitudinal holders approximately one width of the longitudinal holders in the direction of movement though at least one feed cycle by means of a controller controlling the drive means. The quantity of longitudinal holders preferably does not exceed 100.

9 Claims, 2 Drawing Sheets

TRANSPORTING DEVICE FOR LONGITUDINAL HOLDERS

BACKGROUND OF THE INVENTION

This invention relates generally to tube filling devices. More particularly, this invention relates to a tube filling device comprised of a transport table for transporting long receiving holders for tube adapters. Such a tube filling device is known from German Patent No., 43 02 014. German Patent No. 43 02 014 discloses a tube filling device in which the tubes in a carton are first isolated in both spatial directions of the transport plane and then set head first into long receiving holders. These receiving holders are subsequently transported to the various work stations of the tube filling device. In accordance with this patent, the receiving holders are firmly attached to a circulating conveyor belt mounted on a straight transport line. Over the length of the work line, there are roughly 100 receiving holders arranged one after another with their long sides adjacent while on the bottom of the transport chain or continuous conveyor belt. Meanwhile, another 100 receiving holders are transported in the opposite direction, similarly to an escalator. Each receiving holder is generally made of metal, and even when constructed of light weight materials, each receiving holder still weighs at least one kilogram. This means that the receiving holders alone total a weight of 200 kilograms which must be moved by the device apart from the weight of the conveyor belt or chain. This weight must be constantly accelerated and/or stopped, dependent on the work or feed process. This results in considerable stress being placed on the whole mechanical propulsion unit and also on the conveyor elements.

With other known tube filling devices, the tubes are filled on round tables by rotating the round table with respect to the various work stations. These round table devices have the disadvantage that relatively high angle speed must be used to feed the tubes from one station to another in order to achieve a satisfactory throughput. Thus, the transport and conveyor devices are subject to considerable wear with these machines as well as the machines of the type disclosed in German Patent No. 43 02 014 discussed hereinbefore.

Therefore, there is a perceived need for a tube filling device that has improved throughput with reduced stress on the components involved in transporting the receiving holders.

SUMMARY OF THE INVENTION

The above discussed and other problems and deficiencies of the prior art are overcome or alleviated by the tube filling device of the present invention. In accordance with the present invention, a tube filling device is provided which comprises a multiplicity of receiving holders movable by transport devices and drive means.

In accordance with the present invention, the receiving holders, referred to hereinafter simply as "holders", are put into a circuit. In principle, they are arranged so they can move freely in relation to one another. In this way, the number of holders used can be limited to a maximum of 100, and preferably even under 50 (since in the prior art, 50% of the holders on the bottom of the conveyor belts or transport chains are sent back unused to the first transport station). In accordance with the present invention, all or substantially all of the holders in the circuit are used. The holders are moved forward by transport devices which at least engage in points of contact on the holders during a feed cycle, in order to move them forward in the direction of the work circuit.

Additionally, it is an advantage if the holders are grasped and moved forward only during the feed cycle by the means of contact on the transport device, and the rest of the time they are out of contact with the holders. The holders are generally designed as long cuboids made of metal, which have vertical boreholes on top for tube adapters that are then intended to hold one or more tubes of a certain type. On the bottom, the holders preferably have small recesses as points of contact that are then grasped by pins on the transport device that point vertically upward. The pins go into the recesses on the bottom of the holders when the transport device makes a vertical movement and then move roughly the width of the holder in the feed direction when there is a horizontal movement, after which the pins are moved back down vertically and thus come out of contact with the holders. This has the advantage that the holders can be directed precisely at certain geometric points at various work stations, potentially again by lateral means of compression and lateral stops or guides, etc. which is not possible if the holders were directly connected to the transport device.

Preferably, the perpendicular pins that fit into the recesses in the holders are placed on horizontal strips, which extend in the longitudinal direction of two work lines running parallel to one another, between which the holders are moved. The transport direction on these work lines runs in the opposite direction. There is therefore a circuit shaped like a square or rectangle. The strips with the pins pointing up are now moved against the holders and in the feed direction by a horizontal/vertical drive. Such a drive can, for example, contain a circular guide like the pedals on a bicycle. With this type of combined horizontal/vertical movement by a corresponding design of the drive units, for example longitudinal holes and curved disks, the vertical movement can be equalized as much as possible by the horizontal movement. However, a separate drive for the horizontal and vertical movement is preferred; so that these movements can take place independently of one another, which gives greater freedom in terms of clock control. The separate horizontal and vertical drives can, for example, be composed of pneumatic drives.

The present invention has the advantage that because of the full use of almost all holders, the number of holders can be cut at least in half. This makes the masses moved smaller, which causes less mechanical stress on the whole transport device. Furthermore, the holders always move through the various work stations, like the rotating tube aligner, filling devices, soldering devices, etc. by just the width of the holder, i.e., a path of roughly 5 to 100 mm.

In the square or rectangular arrangement, described above, of the circuit with two work lines, whose feed direction is opposite, the start and end of each work line is connected to the other by transfer stations, at which the holders are moved from one work line in the direction of their longitudinal axis to another work line. At these transfer stations, there can be a changer unit which, for example, when there is a change in tube desired size, changes all holders of another type in the circuit, i.e., identical holders with other tube adapters. Such a change can be fully automatic on a known number of holders used, for example 40, which is a very manageable number.

It should be noted that the present invention therefore makes it possible to produce a tube filling device with lower cost, since a smaller number of holders is necessary. It should be further noted that mechanical stress on the transport device is considerably relieved by the reduced number of holders and the consequently reduced weight and also by the small paths on the work lines, so that the work can be done with smaller sized drives or a transport device with much lower maintenance.

The above discussed and other features and advantages of the present invention will be appreciated and understood by those of ordinary skill in the art from the following detailed discussion and drawings:

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
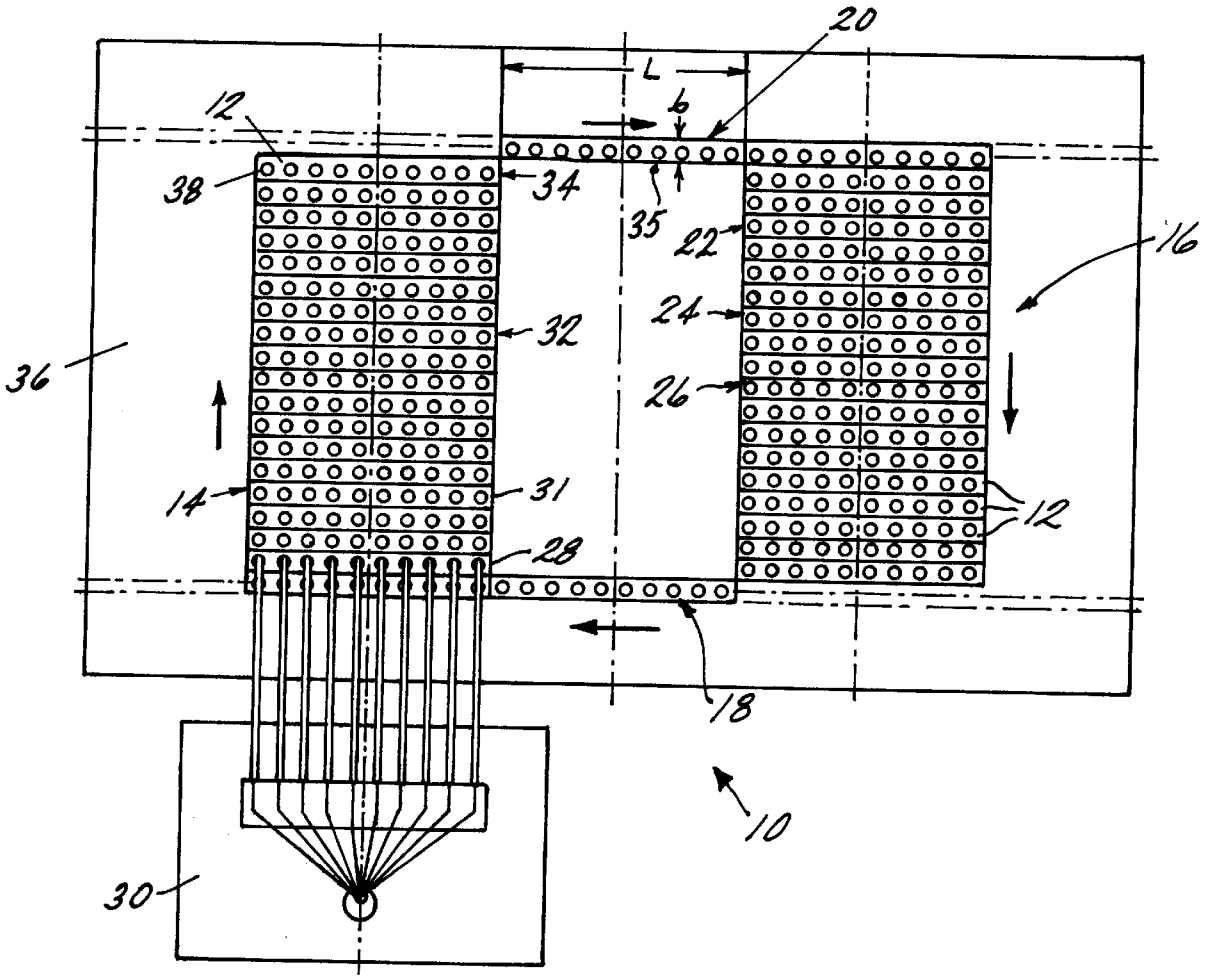
FIG. 1 is a top view of a tube filling device in accordance with the present invention in a version showing forty holders which are moved or transported in a square or rectangular circuit.

Referring first to FIG. 1, the tube filling device of the present invention is shown generally at 10. FIG. 1 shows a tube filling device 10 with a square or rectangular circuit of forty longitudinal holders 12, whose length L (in a preferred embodiment) is approximately 80 cm and whose width b is approximately 8 cm. The holders 12 run in opposite directions in two work lines 14, 16 parallel to one another (see the arrows on the outer edge of the work lines) and are connected to one another in front by transfer lines or stations 18, 20. On the work lines, the holders 12 are moved forward by a work clock always only by the width b of the holders, while the holders at the transfer stations 18 and 20 are moved in the longitudinal direction at least by their length L (of, for example, 80 cm) in order to transfer the holders 12 between the two work lines 14 and 16.

Next, a description will be given of how the tubes in the tube filling device shown are filled.

The filling starts on the right work line 16 above work station 22, at which the holders 12 with tube adapters (not shown) have empty tubes. The holders are now moved in rows downward in the direction of the cleaning station 24, where the empty tubes are sterilized and cleaned. Next, the holders 12 are pushed to an alignment station 26, at which the printed side of the tubes is pointed in a definite direction. If the tubes reach the bottom end of the work line 14, they are filled at the metering station 28 by means of a metering pump 30. The second work line 14 has a transport device identical to the first work line 16 which is only operated in the opposite direction, i.e., in the drawing from bottom to top. The two transport devices for work lines 14, 16 can also be connected to one another mechanically, for example via a reverse drive, so that only one drive is necessary for both. From the metering, i.e., filling station 28, the holders 12 are now moved to the closing station 31, where the top edge of the tube is either crimped or soldered. If the ends of the tubes are soldered, the soldering station has a trim station 32 arranged after it at which the ends of the tubes are trimmed, i.e., cut to a certain geometric length and/or heat treated for a certain appearance. Finally, the holders 12 are moved on the second work line 14 up to the take-off station 34, where they are transferred to a take off belt in trays or cartons. During the whole cycle, the holders 12 are preferably arranged on a table 36, which has corresponding guides, to make sure the holders are oriented precisely on the various work stations. At transfer station 20, the holders 12 are transferred to the first work station 22.

At transfer station 20, a changer device 35 is provided, whereby holders 12 with a certain type of tube adapter can be replaced with another type of tube adapter. The change is made automatically by the changer device 35, so that a tube change can be made with no interruption in the work process.

Figure 2:
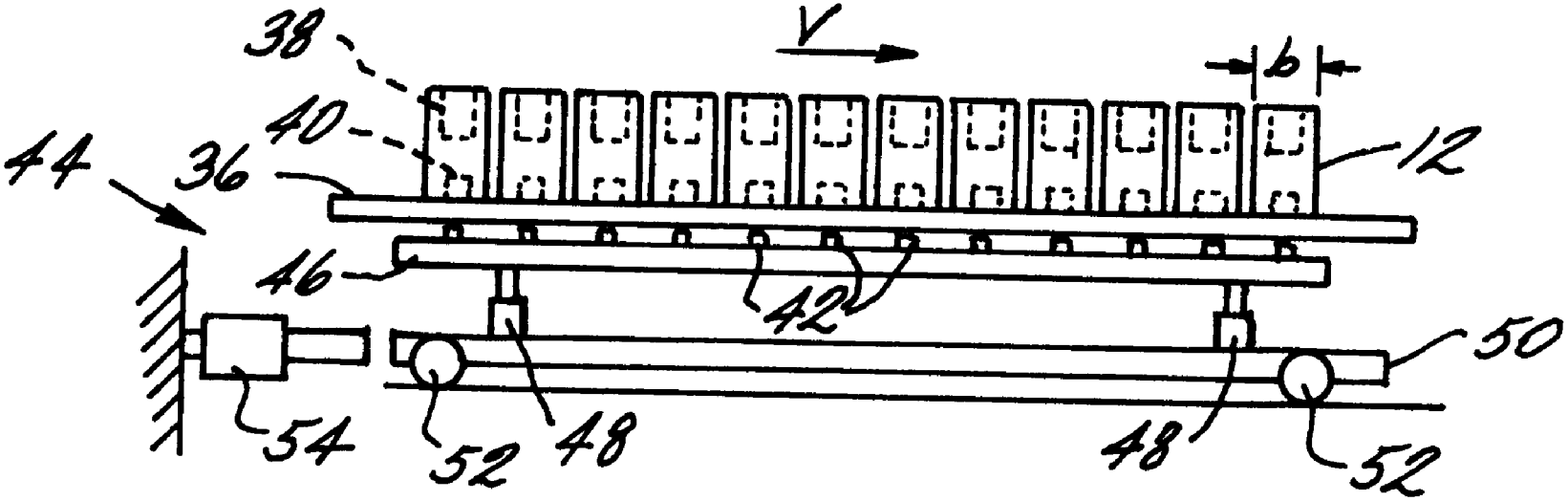
FIG. 2 is a side elevation view shown in the direction V of the tube filling device of FIG. 1 in which one of the transport devices for feeding the holders is shown in accordance with the present invention.

The details of the holders 12 are described in greater detail in FIG. 2 along with the transport device for the holders 12.

On top of each holder 12, there are ten or more vertical boreholes 38 for tube adapters in which empty tubes can be set head first, so that their open, back end points up vertically for filling. On the bottom, the holders have, as points of contact in the area of their longitudinal ends, two cylindrical recesses 40 which are designed to engage with pins 42 pointing vertically up on a transport device 44. The pins 42 pointing vertically up are arranged on two strips 46 parallel to one another which run under the recesses 40 in the longitudinal direction of the work lines 14, 16. Thus, two strips 46, parallel to one another are necessarily whole pins 42 which go through the two recesses 40 and thus grasp the holders in a definite way. The strips 46 are arranged on a horizontal movable cart 50 via vertical hydraulic servo drives, which, for example can be driven on wheels 52 or by means of a sliding guide (not shown) under table 36 in the longitudinal direction of work lines 14, 16. The cart 50 is also driven longitudinally by a pneumatic drive 54. Before the holders are transported, the holders are supported on a table 36 which includes openings for the pins 42 and the strips 46 to pass through. To transport the holders 12 in the direction of arrow V, the pneumatic drive 54 moves in its contracted position, and the two vertical pneumatic drives 48 move up and go into the recesses 40 in the holders 12. This lifts the holders 12 somewhat off the work table 36, shown in dashes. Now the hydraulic cylinder 54 runs in its extended position, wherein the cart 50 is move forward a little bit more than the width "b" of the holder 12 in the direction of arrow V. Now, the two vertical pneumatic drives 46 are lowered again, and all the holders 12 are set down one position further to the right on the work table 36.

Such a transport device 44 could, in principle, also be provided for transfer stations 18, 20, in order to transfer a holder from one work line to another. But in this embodiment, only one strip with two pins 42 pointing vertically up would be provided that would then fit into the two recesses 40 of a single holder, so that at the transfer stations, only one single holder would then always be transferred by the transfer device, while in the drawing shown, roughly nineteen or more holders are moved forward at the same time. With the transfer device shown, the lifting and lowering of the holders and the feed movement are disconnected, which permits optimized clocking of the feed and work cycles. However, it will be appreciated that other conventional feed mechanisms can also be used for the holders.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A transporting device for longitudinal holders comprising:

a table for supporting longitudinal holders, wherein said longitudinal holders can move freely relative to each other and can be moved through various work stations of the transporting device in a circuit; and wherein each of said longitudinal holders have points of contact for engagement by the transport device in order to move each of said longitudinal holders forward to each of said work stations by approximately the distance of one width of each of said longitudinal holders in the direction of movement, whereby the movement of the longitudinal holders is performed by a combined vertical and horizontal movement of said transport device thereby lifting said longitudinal holders from the table and replacing it in said distance of approximately one width on the table, whereby the transport device is designed in such way as to engage with said points of contact only during a feed movement of said longitudinal holders whereas during the remainder of a cycle time said transport device is out of contact with said longitudinal holders.

2. The transporting device of claim 1 wherein:

said transport devices comprises strips with pins pointing upwardly, said pins fitting into corresponding recesses in the bottom of said longitudinal holders and said strips being movable in both the vertical and horizontal directions.

3. The transporting device of claim 2 wherein:

said transport device is provided with separate drives for the vertical and horizontal movement of said strips.

4. The transporting device of claim 1 further comprising:

means to move said longitudinal holders in a square or rectangular closed circuit transport path, wherein two linear work lines are provided that run in the opposite direction of said square or rectangular transport path and said longitudinal holders can be controlled to move by approximately one width of said longitudinal holders; and wherein, said work lines are so arranged for said longitudinal holders to have thin longitudinal sides adjacent to one another; and wherein front and back ends of said work lines have a transfer station with means to move said longitudinal holders on a transfer line that runs perpendicular to said work lines in the direction of said longitudinal holder's longitudinal axis.

5. The transporting device of claim 4 wherein:

a changer device at said transfer station adapted to change a first set of said longitudinal holders in exchange for a second set of longitudinal holders in said circuit at least once within one complete cycle.

6. The transporting device of claim 5 wherein:

said transport device includes strips with pins pointing upwardly which fit into corresponding recesses on the bottom of said longitudinal holders, wherein said strips can be moved in vertical and horizontal directions.

7. The transporting device of claim 1 wherein:

said transport device has separate drives for the vertical and horizontal movement of said strips.

8. The transporting device of claim 1 wherein:

the number of said longitudinal holders used in said circuit does not exceed about 100 in quantity.

9. A transporting device for longitudinal holders comprising:

a table having one or more openings;

a plurality of holders supported by said table, each holder having a plurality of recesses for receiving a pin therein;

a cart dispositioned below said table, said cart having a horizontal drive and a vertical drive for lifting and transport of said holders during a feed cycle and for completely disengaging said holders between said feed cycles; and, a plurality of strips, each strip having a plurality of said pins, each of said pins aligned to pass through said table and pass into said recess during the feed cycle, each of said strips operably connected to each of said drives.

* * * * *